US008305068B2

(12) United States Patent
Camacho Galeano et al.

(10) Patent No.: US 8,305,068 B2
(45) Date of Patent: Nov. 6, 2012

(54) VOLTAGE REFERENCE CIRCUIT

(75) Inventors: Edgar Mauricio Camacho Galeano, Campinas (BR); Alfredo Olmos, Austin, TX (US); Andre Luis Vilas Boas, Campinas (BR)

(73) Assignee: Freescale Semiconductor, Inc., Austin, TX (US)

( * ) Notice: Subject to any disclaimer, the term of this patent is extended or adjusted under 35 U.S.C. 154(b) by 540 days.

(21) Appl. No.: 12/626,321

(22) Filed: Nov. 25, 2009

(65) Prior Publication Data

US 2011/0121809 A1 May 26, 2011

(51) Int. Cl.
*G05F 3/16* (2006.01)

(52) U.S. Cl. ..... 323/313

(58) Field of Classification Search ..... 323/312–315; 327/512, 539
See application file for complete search history.

(56) References Cited

U.S. PATENT DOCUMENTS

| | | | | |
|---|---|---|---|---|
| 4,769,589 | A | 9/1988 | Rosenthal | |
| 5,818,212 | A | 10/1998 | Min et al. | |
| 6,002,243 | A | 12/1999 | Marshall | |
| 6,040,720 | A | 3/2000 | Kosiec | |
| 6,150,851 | A | 11/2000 | Ohmi et al. | |
| 6,518,833 | B2 | 2/2003 | Narendra et al. | |
| 6,919,753 | B2 | 7/2005 | Wang et al. | |
| 7,119,527 | B2 | 10/2006 | Fernald | |
| 7,199,646 | B1 * | 4/2007 | Zupcau et al. | 323/314 |
| 7,236,048 | B1 * | 6/2007 | Holloway et al. | 327/539 |
| 7,579,898 | B2 * | 8/2009 | Soldera et al. | 327/512 |
| 2004/0093531 | A1 * | 5/2004 | Espinor et al. | 713/340 |
| 2006/0001412 | A1 * | 1/2006 | Fernald | 323/313 |
| 2008/0061863 | A1 * | 3/2008 | De Barros Soldera et al. | 327/512 |
| 2008/0218253 | A1 | 9/2008 | Pietri et al. | |
| 2010/0127687 | A1 | 5/2010 | Boas et al. | |

OTHER PUBLICATIONS

Camacho-Galeano, E.M., et al., "Temperature Performance of Sub-1V Ultra-Low Power Current Sources", Department of Electrical Engineering, Federal University of Santa Catarina, Florianopolis, Brazil.

Camacho-Galeano, E.M., et al., "A 2-nW 1.1-V Self-Biased Current Reference in CMOS Technology", IEEE Transactions on Circuits and Systems, vol. 52, No. 2, Feb. 2005.

Camacho-Galeano, E.M., et al., "Design of an Ultra-Low-Power Current Source", Departamento de Engenharia Electrica, Universidade Federal de Santa Catarina, Brazil.

Camacho-Galeano, E.M., et al., "An Ultra-Low-Power Self-Biased Current Reference", SBCCI'04, Sep. 7-11, 2004, Pernambuco, Brazil, copyright 2004 ACM 1-58113-947-0/04/0009.

Giustolisi, G., et al., "A Low-Voltage Low-Power Voltage Reference Based on Subthreshold MOSFETs", IEEE Journal of Solid State Circuits, vol. 38, No. 1, Jan. 2003.

DeVita, G., et al., "A Sub-1-V, 10 ppm/°C, Nanopower Voltage Reference Generator", IEEE Journal of Solid-State Circuits, vol. 42, No. 7, Jul. 2007.

(Continued)

*Primary Examiner* — Jue Zhang

(57) ABSTRACT

A bandgap voltage reference unit on an integrated circuit (101) includes a proportional-to-absolute-temperature (PTAT) current source (100) coupled to a bandgap voltage reference circuit (200) that includes a plurality of self-cascode MOSFET structures (201-204) that are cascaded together to form a PTAT voltage generator (205). The bandgap voltage reference circuit also includes a complementary-to-absolute-temperature (CTAT) device (260). A PTAT voltage from the PTAT voltage generator is added to a CTAT voltage from the CTAT device to produce an output voltage of the bandgap voltage reference unit, such that the output voltage is the bandgap voltage of the integrated circuit and such that the output voltage does not change with temperature.

20 Claims, 4 Drawing Sheets

OTHER PUBLICATIONS

Wang, H., et al., "A CMOS Voltage Reference Without Resistors for Ultra-Low Power Applications", 1-4244-1132-7/07, 2007 IEEE.
Olmos, A., et al., "A Sub-1V Low Power Temperature Compensated Current Reference", 1-4244-0921-7/07, 2007 IEEE.
Buck, A.E., et al., "A CMOS Bandgap Reference Without Resistors", IEEE Journal of Solid-State Circuits, vol. 37, No. 1, Jan. 2002.
Rossi, C., et al., "PTAT Voltage Generator based on an MOS Voltage Divider".
Ueno, K., et al., "A 300 nW, 15 ppm/°C, 20 ppm/V CMOS Voltage Reference Circuit Consisting of Subthreshold MOSFETs", IEEE Journal of Solid-State Circuits, vol. 44, No. 7, Jul. 2009.
Rossi, C., et al., "Ultra-Low Power CMOS Cells for Temperature Sensors", SBCCI'05, Sep. 4-7, 2005, Florianopolis, Brazil, Copyright 2005, ACM 1-59593-174-0/05/0009.

* cited by examiner

300

400

VOLTAGE REFERENCE CIRCUIT

BACKGROUND OF THE INVENTION

1. Field of the Invention

This invention relates generally to voltage reference circuits, and more specifically to a bandgap voltage reference circuit.

2. Related Art

A system-on-chip (SoC) may include a voltage regulator. The voltage regulator remains activated when all other circuits of the SoC are off. The voltage regulator may include a voltage reference circuit. A voltage reference circuit is a circuit that outputs a fixed DC voltage that does not change with temperature or changes within a limited range, i.e., a few millivolts above and below a given value. When the SoC is powered by a battery, it is particularly important that the power consumed by the voltage regulator, including the power consumed by the voltage reference circuit, be low.

A bandgap voltage reference circuit is a voltage reference circuit that outputs a fixed DC voltage at or near the bandgap of the semiconductor substrate on which the circuit resides. A bandgap voltage reference circuit, or bandgap voltage reference, may include a proportional-to-absolute-temperature (PTAT) circuit and a complementary-to-absolute-temperature (CTAT) device. The PTAT circuit produces a voltage that increases linearly with temperature. The CTAT device produces a voltage that decreases linearly with temperature. It is well known that $V_{BE}$, the voltage across a forward-biased base-emitter junction of a bipolar junction transistor (BJT), exhibits nearly a CTAT behavior. The bandgap voltage reference includes means to properly combine the voltage produced by the PTAT circuit and the voltage produced by the CTAT device. The bandgap voltage reference cancels the negative temperature dependence of the CTAT device with the positive temperature dependence of the PTAT circuit to produce an output $V_{out}$ that does not change with temperature.

The PTAT circuit includes a thermal voltage generator that generates a thermal voltage $\phi_t$=kT/q, where T is the temperature measured in kelvin, and q is the magnitude of the electrical charge on an electron ($1.602\times10^{-19}$ coulombs). The Boltzmann's constant, k, can be expressed as $1.3806\times10^{-23}$ joules/kelvin. The thermal voltage $\phi_t$ varies directly proportionately, or increases, with increasing temperature. The thermal voltage $\phi_t$ is approximately 25.85 mV at room temperature (approximately 300K). At room temperature, the thermal voltage $\phi_t$ changes at a rate of approximately 0.085 mV/° C.

Because the thermal voltage $\phi_t$ extrapolates to 0V at 0° K and because $V_{BE}$ extrapolates to the bandgap voltage at 0° K (if all its nonlinear terms are ignored), their sum is approximately equal to the bandgap voltage.

The CTAT voltage $V_{BE}$ that the CTAT device produces varies indirectly proportionately, or decreases, with increasing temperature at a rate of approximately −2.4 mV/° C., for a very low current density, i.e., in the range of a few nanoamperes (nA) per square micron.

The PTAT circuit amplifies the thermal voltage $\phi_t$ by an appropriate constant $\chi$ to produce a voltage $\chi\phi_t$ such that a rate of increase of the PTAT voltage $\chi\phi_t$ produced by the PTAT circuit compensates for a rate of decrease of the CTAT voltage $V_{BE}$ produced by the CTAT device.

The output $V_{out}$ of the bandgap voltage reference can be expressed as:

$$V_{out}=V_{BE}+\chi\phi_t$$

such that $V_{out}$ has a zero temperature coefficient (ZTC). Therefore, the value of $\chi$ is chosen such that, at room temperature (300° K), $$(\delta V_{out}/\delta T)|_{T=300^\circ K}=(\delta V_{BE}/\delta T)|_{T=300^\circ K}+(\chi\delta\phi_t/\delta T)_{T=300^\circ K}=0$$

After substituting the aforesaid rate of decrease of $V_{BE}$ and rate of increase of $\phi_t$ into the preceding equation, it is found that $\chi\approx28.235$ under the conditions stated.

Using the Advanced Compact Model (ACM) for a metal oxide semiconductor field effect transistor (MOSFET), the inversion level $i_f$ of a MOSFET transistor is defined as $i_f=I/I_s$, where I is the drain current in the transistor, and $I_s$ is the normalization current. The normalization current $I_s$ is equal to $I_{SQ}S$, where $I_{SQ}$ is the sheet specific current that is defined by certain process parameters and S is the aspect ratio of the transistor. The aspect ratio S of a MOSFET transistor is the ratio of channel width W to channel length L. Furthermore, $$I_{SQ}=n\mu C'_{ox}(\phi_t^2/2)$$

where $\mu$ is the mobility of the carriers in the channel, n is the subthreshold slope factor, $C'_{ox}$ is the oxide capacitance per unit area of the gate, and $\phi_t$ is the thermal voltage. Weak inversion, moderate inversion and strong inversion describe different operational modes of a MOSFET. Weak inversion occurs when a transistor is dominated by a diffusion current, moderate inversion is when a transistor has both a diffusion current and a drift current, and strong inversion is when a transistor is dominated by a drift current. In a MOSFET, weak inversion occurs when a thinner channel is formed in the transistor. When there is no channel, the transistor is at cut-off. As a rule of thumb, a transistor that has an inversion level of less than one is said to be in weak inversion. A transistor that has an inversion level of about 1-100 is said to be in moderate inversion. A transistor that has an inversion level of greater than 100 is said to be in strong inversion.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION OF EXEMPLARY EMBODIMENTS

Figure 1:
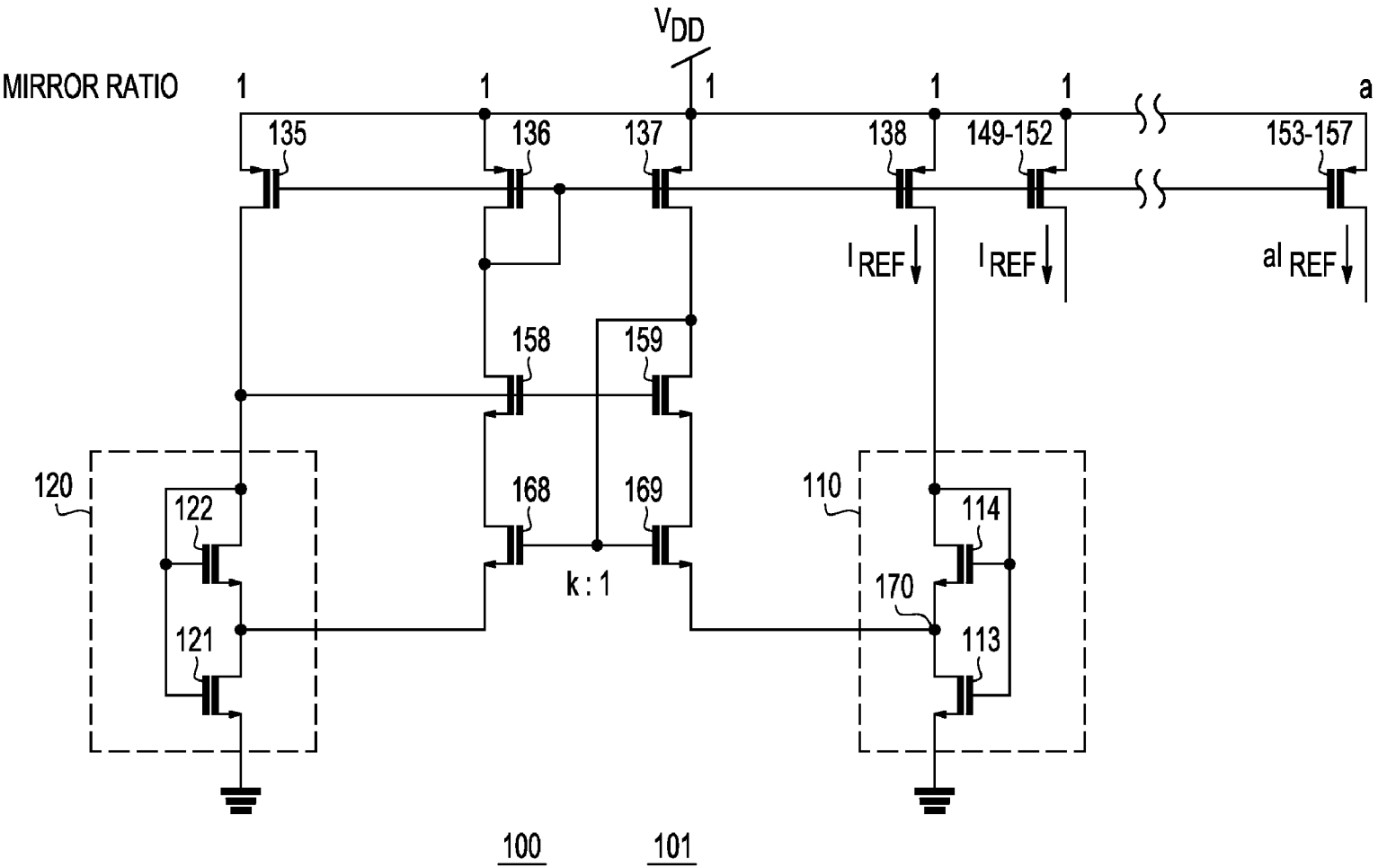
FIG. 1 is a schematic of a proportional-to-absolute-temperature (PTAT) current source without a start-up circuit.

FIG. 1 is a schematic of a proportional-to-absolute-temperature (PTAT) current source 100. The PTAT current source 100 is a resistor-less, low-power, low-voltage, current source. In one embodiment, the PTAT current source 100 is disposed on a substrate of an integrated circuit 101 and is part of a voltage regulator circuit of a SoC. The fact that the PTAT current source 100 is resistor-less advantageously reduces the area that it occupies on the substrate compared to a current source that uses resistors. The PTAT current source 100 comprises a PTAT voltage source that is implemented by a self-cascode MOSFET structure (hereinafter "SCM") 110, which includes transistor 113, and transistor 114 that is connected in a diode configuration, and which are biased in weak inversion. Transistor 113 operates in the linear region. Transistor 114 operates in the saturated region. The PTAT voltage appears at node 170, which is at the drain terminal of transistor 113. The PTAT current source 100 implements voltage-to-current conversion by another SCM 120, which includes transistor 121 and transistor 122 that is connected in a diode configuration, and which are biased in moderate inversion. Transistor 121 operates in the linear region. Transistor 122 operates in the saturated region. The sizes of transistors 121 and 122 are selected so that transistor 121 acts as a large resistor. Transistors 136, 137, 158, 159, 168 and 169 form a self-biasing voltage-following current mirror that applies the PTAT voltage at node 170 of SCM 110 into the drain terminal of transistor 121 of SCM 120 for k=1 between transistor 168 and transistor 169. Transistor 136 is connected as a diode and defines the gate voltage for transistors 135, 137, 138 and 149-157. Transistor 138 is coupled to SCM 110. In one embodiment, the current through transistor 136 is 5 nA. Transistors 149-152 are of a same size and have a mirror ratio of 1:1 with transistor 136. As a result, the current through each of transistors 135 and 149-152 is the same as, or mirrors, the current through transistor 136. Each of transistors 153-157 mirrors the current through transistor 136 and the amount of current through each of transistors 153-157 depends on a mirror ratio "1:a" that each transistor 153-157 has with transistor 136. In one embodiment, transistors 135-157 are PMOS transistors, and transistors 113, 114, 121, 122, 158, 159, 168 and 169 are NMOS transistors. In one embodiment, $V_{DD}$ may range between 1.5V to 3.6V and the current $I_{ref}$ will advantageously remain at 5 nA, at room temperature. The PTAT current source 100 may include a start-up circuit (not shown in FIG. 1) that ensures that the PTAT current source starts in a desired state. The design and operation of the PTAT current source 100 is described more fully in TEMPERATURE PERFORMANCE OF SUB-1V ULTRA-LOW POWER CURRENT SOURCES by Camacho-Galeano et al., which is hereby fully incorporated herein.

Figure 2:
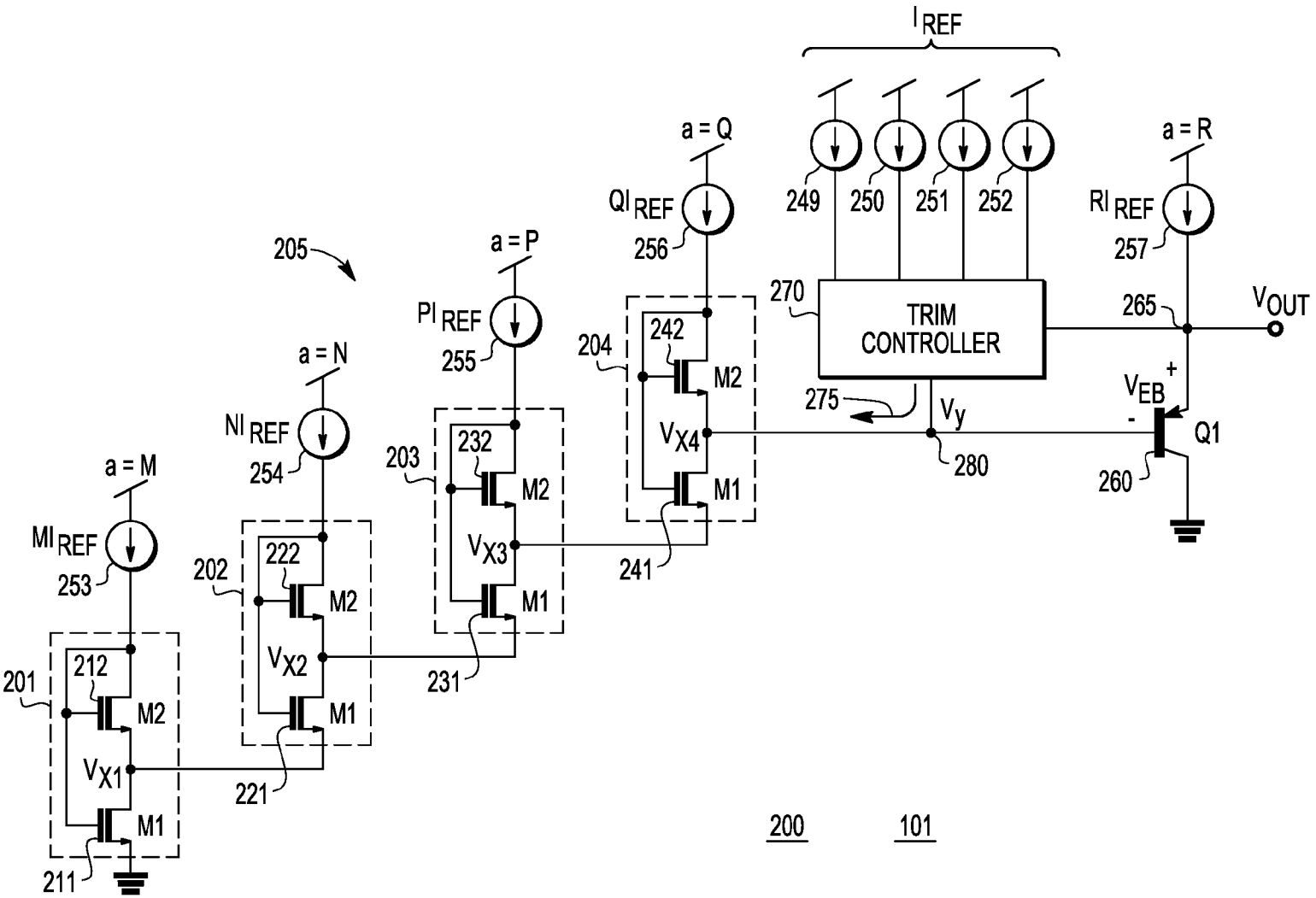
FIG. 2 is a schematic of a voltage reference circuit in accordance with one embodiment of the invention.

FIG. 2 is a schematic of a voltage reference circuit that is a bandgap voltage reference 200 in accordance with one embodiment of the invention. In one embodiment, bandgap voltage reference 200 is disposed on a substrate of an integrated circuit and is part of a voltage regulator circuit of a SoC. The PTAT current source 100 provides several current branches to the bandgap voltage reference 200. In the embodiments shown in FIGS. 1 and 2, the PTAT current source 100 and the bandgap voltage reference 200 are disposed on a same substrate of the same integrated circuit 101. The bandgap voltage reference 200 is based on the bandgap principle.

The bandgap voltage reference 200 includes a PTAT voltage generator 205. In one embodiment, the PTAT voltage generator 205 comprises a plurality of SCMs 201-204 operating in moderate inversion. The SCMs 201-204 are appropriate for low power applications because they can be biased with a very small amount of current, i.e., in the range of 5 nA. Advantageously, the SCMs 201-204 do not include any resistors, and, therefore, they occupy less area than PTAT circuits that include resistors occupy. In one embodiment, the PTAT voltage generator 205 comprises four (4) SCMs 201-204. Each SCM 201-204 comprises a transistor M1 and a transistor M2 connected in a self-cascode MOSFET configuration. In the embodiment shown in FIG. 2, transistor M1 and transistor M2 of each SCM 201-204 are NMOS transistors. For example, SCM 201 comprises NMOS transistor M1 211 and NMOS transistor M2 212. Transistor 211 operates in the linear (triode) region. Transistor 212 operates in the saturation region. Transistor 211 acts as a resistor. The transistor 212 is coupled to a PTAT current source 253. In the embodiments shown in FIGS. 1 and 2, the drain of NMOS transistor 212 is coupled to the drain of PMOS transistor 153. The source of transistor 212 is connected to the drain of transistor 211. The source of transistor 211 is coupled to ground.

Similarly, SCMs 202-204 comprise transistors 221 and 222, transistors 231 and 232, and transistors 241 and 242, respectively, each pair of transistors connected in a self-cascode MOSFET configuration. For example, in SCM 202, the drain of transistor 222 is coupled to a PTAT current source 254. In the embodiments shown in FIGS. 1 and 2, the drain of NMOS transistor 222 is coupled to the drain of PMOS transistor 154. The source of transistor 222 is connected to the drain of transistor 221. The source of transistor 221 is coupled to the drain of transistor 211 of SCM 201. The SCMs 203 and 204 are analogously coupled, as illustrated in FIG. 2.

Each SCM 201-204 contributes with a PTAT voltage $V_{x1}$, $V_{x2}$, $V_{x3}$ and $V_{x4}$, respectively, at the drain of transistor 211, 221, 231 and 241, respectively. For example, $V_{x1}$ of SCM 201 is the drain-to-source voltage ($V_{DS}$) of transistor 211. It can be shown that $V_{xi}$ is as follows:

$$V_{Xi} = \phi_t\left[\sqrt{1+\alpha_i i_{f2}} - \sqrt{1+i_{f2}} + \ln\left(\frac{\sqrt{1+\alpha_i i_{f2}}-1}{\sqrt{1+i_{f2}}-1}\right)\right]$$

where $\alpha_i$ may be different for each SCM, and where:

$$\alpha_i = \text{function}\left(\frac{S_2}{S_1}, M, N, P, Q, R, \beta\right)$$

where $S_2$ and $S_1$ are aspect ratios of transistors M1 and M2, respectively; M, N, P, Q and R are mirror ratios; and β is the current gain of a bipolar transistor that provides a CTAT voltage.

It can be shown that $V_{x4}$ of SCM4 204 is $V_{DS}$ of transistor 241 of SCM4 plus $V_{x3}$ plus $V_{x2}$ plus $V_{x1}$. The output $V_y$ of the PTAT voltage generator 205 appears at a node 280. Therefore, the voltage generated by the PTAT voltage generator 205 at node 280 is:

$$V_y = V_{x1} + V_{x2} + V_{x3} + V_{x4}.$$

The bandgap voltage reference 200 includes a CTAT device 260 that provides the CTAT voltage. In one embodiment, the CTAT device 260 is a bipolar transistor. In one embodiment, the bipolar transistor is a PNP bipolar transistor and the CTAT voltage is its emitter-to-base voltage ($V_{EB}$). The SCMs 201-204 compensate for variation with temperature of $V_{EB}$ of the CTAT device 260. The number of SCMs needed to compensate for variation of $V_{EB}$ with temperature depends on current density and process. To have a good trade-off between area and current consumption, the PTAT voltage generator 205 should comprise at least two SCMs. As the value of $V_{EB}$ increases, more SCMs may be needed. For example, when $V_{EB}$=0.72V, as many as five (5) SCMs may be needed. On the other hand, when $V_{EB}$=0.55V, as few as three (3) SCMs may be needed. For any given $V_{EB}$, the output voltage $V_{EB}$ of the bandgap voltage reference 200 increases as the number of SCMs increases. In the embodiment shown in FIG. 2, each of the SCMs 201-204 is identical to the other. In another embodiment (not shown), one or more of the SCMs are different from each other.

The bandgap voltage reference 200 also includes current mirrors 253-257 that bias the cascade of SCMs 201-204 and the CTAT device 260. In the embodiments shown in FIGS. 1 and 2, each current mirror 253-257, respectively, comprises a PMOS transistor 153-157, respectively, that operates in strong inversion and in the saturation region. The PMOS transistor 153-157 of each current mirror 253-257 operates in strong inversion because the current flowing in such PMOS transistors are copy currents that need to be nearly equal to the current flowing in transistor 136 of the PTAT current source 100 even at small values of current, i.e., in the range of nanoamperes. The channel width and channel length of the PMOS transistor 153-157 of each current mirror 253-257 are carefully chosen so that the PMOS transistor has sufficient tolerance to operate in strong inversion. The size of each PMOS transistor 153-157 of each current mirror 253-257 corresponds to a mirror ratio with regard to transistor 136 of the PTAT current source 100 of 1:M, 1:N, 1:P, 1:Q and 1:R, respectively. In one embodiment, M=N=P=Q=1, and R=3. In other embodiments, M, N, P and Q may have values other than "1" and may have values unequal from each other. The SCMs 201-204 and the CTAT device 260 of the bandgap voltage reference 200 are biased by the current mirrors 253-257 of the PTAT current source 100. In the embodiment in which M=N=P=Q=1, and R=3, the SCMs 201-204 are biased by a 5 nA current, and the CTAT device 260 is biased by a 15 nA current.

A simple voltage addition operation is obtained by coupling $V_y$, the voltage generated by the PTAT voltage generator 205, in series with $V_{EB}$, the CTAT voltage of the CTAT device 260. In the embodiment shown in FIG. 2, the CTAT device 260 is a PNP bipolar transistor. In the embodiment shown in FIG. 2, the transistor has a base terminal coupled to node 280, an emitter terminal coupled to an output node 265 of the bandgap voltage reference 200 and a collector terminal coupled to ground potential. In one embodiment, because of the lower bias current being used and because the bipolar transistor of the CTAT device 260 is a PNP bipolar transistor, β of the bipolar transistor is in the range of 1-10.

In another embodiment, the CTAT device 260 comprises two bipolar transistors (not shown) connected in a Darlington configuration, and the output voltage $V_{out}$ in such embodiment is approximately twice the bandgap voltage. In still another embodiment, the CTAT device 260 is a diode (not shown) with its anode terminal coupled to the output node 265 and its cathode terminal coupled to node 280. In one such embodiment where a diode is used instead of the bipolar transistor for the CTAT device 260, the bandgap voltage is approximately 1.285V and the voltage across the diode is approximately 0.64V, when the bandgap voltage reference 200 is fabricated using a 90 nm process. In yet another embodiment, the CTAT device 260 comprises two diodes (not shown) connected in series, and the output voltage $V_{out}$ in such embodiment is approximately twice the bandgap voltage.

The bandgap voltage reference 200 includes means for trimming the output voltage $V_{out}$ in response to a not-well-compensated behavior over temperature. The means for trimming includes a plurality of current mirrors and a trim controller 270. In the embodiment shown in FIG. 2, there are four (4) current mirrors 249-252 coupled to the trim controller 270. In the embodiments shown in FIGS. 1 and 2, each current mirror 249-252, respectively, comprises a PMOS transistor 149-152 that operates in strong inversion and in the saturation region. In the embodiment shown in FIG. 2, each PMOS transistor 149-152 of the current mirrors 249-252 has a ratio of 1:1 with transistor 136. The trim controller 270 selectively couples one or more of the current mirrors 249-252 to node 280. For trimming, a trim current 275 is selectively added or not at node 280 depending upon a present value of $V_{out}$ compared to a desired value for $V_{out}$ and its behavior over temperature. For example, if it is found that $V_{out}$ decreases with temperature, trim current is added to increase the PTAT component at the output of the bandgap voltage reference 200. By changing the amount of trim current 275, the amount of current flowing through the SCMs 201-204 changes accordingly. In the embodiment shown in FIG. 2, the trim current is one of 0 nA, 5 nA, 10 nA, 15 nA and 20 nA. The trim current 275 does not flow through the CTAT device 260. In one embodiment, trimming is attained by adjusting the current branch of SCM 204 only, as illustrated in FIG. 2. In another embodiment (not shown), the current branch in more than one SCM 201-204 or in all SCMs is separately trimmed.

The SCMs 201-204 do not operate in strong inversion because if they did operate in strong inversion the area that each SCM occupies would be much larger, and the number of SCMs needed would be the same as if they were operating in moderate inversion; therefore, the area that such a PTAT voltage generator occupies would be disadvantageously larger. The SCMs 201-204 do not operate in weak inversion because if they did operate in weak inversion the PTAT voltage $V_{x1}$, $V_{x2}$, $V_{x3}$ and $V_{x4}$ that each SCM contributes would be much smaller and a greater number of SCMs would be needed than the number of SCMs needed if they were operating in moderate inversion. Furthermore, the slightly smaller area occupied by SCMs that operate in weak inversion would not offset the greater number of SCMs needed; therefore, the area that such a PTAT voltage generator occupies would be disadvantageously larger. Consequently, the SCMs 201-204 should operate in moderate inversion, rather than in strong inversion, to save area.

The PTAT voltage generator 205 generates an approximate output voltage:

$$V_y=\chi\phi_t$$

However, because the embodiment shown in FIG. 2 comprises four (4) SCMs, $$V_y=V_{x1}+V_{x2}+V_{x3}+V_{x4}$$

Therefore, it is more accurate to say that the PTAT voltage generator 205 generates an output voltage of $$V_y=\chi_1\phi_t+\chi_2\phi_t+\chi_3\phi_t+\chi_4\phi_t \qquad \text{Equation (1)}$$

In a bandgap voltage reference 200 that uses a BJT for the CTAT device 260 and that is fabricated with a 0.18 micron process, wherein $V_{out}\approx 1.43V$, $V_{EB}\approx 0.715V$ and $V_y\approx 0.715V$, and wherein it is assumed that $\chi=28$, the PTAT voltage generator 205 generates an output voltage of $28\phi_t$. However, in the embodiment shown in FIG. 2, the SCMs 201-204 are identical; therefore, it is not possible that the value of $\chi$ be identical for each SCM. Consequently, it is not possible for Equation (1) to become $$V_y=28\phi_t=7\phi_t+7\phi_t+7\phi_t+7\phi_t$$

because the current through transistor M1 of each SCM 201-204 is different.

However, because the SCMs 201-204 are identical, but have a decreasing amount of current through them from SCM1 201 to SCM4 204, it is expected that the value of $\chi$ should decrease from SCM1 to SCM4. Therefore, an educated guess may be made for the values of $\chi_1$, $\chi_2$, $\chi_3$ and $\chi_4$, such that a rough estimate of Equation (1) is as follows:

$$V_y=28\phi_t=8.0\phi_t+7.5\phi_t+6.5\phi_t+6.0\phi_t$$

However, more accurate values for $\chi_1$, $\chi_2$, $\chi_3$ and $\chi_4$ can be calculated as follows.

For each SCM 201-204, assuming zero trim current, the $\alpha$ parameter is given by:

$$\alpha_1 = 1 + \frac{S_2}{S_1}\left(1 + \frac{N+P+Q+R/\beta}{M}\right)$$

$$\alpha_2 = 1 + \frac{S_2}{S_1}\left(1 + \frac{P+Q+R/\beta}{N}\right)$$

$$\alpha_3 = 1 + \frac{S_2}{S_1}\left(1 + \frac{Q+R/\beta}{P}\right)$$

$$\alpha_4 = 1 + \frac{S_2}{S_1}\left(1 + \frac{R/\beta}{Q}\right)$$

Therefore, for M=N=P=Q=1, R=3, $\beta$=3, and $S_2/S_1$=8, the above four equations become:

$$\alpha_1 = 1 + \frac{5S_2}{S_1} = 41$$

$$\alpha_2 = 1 + \frac{4S_2}{S_1} = 33$$

$$\alpha_3 = 1 + \frac{3S_2}{S_1} = 25$$

$$\alpha_4 = 1 + \frac{2S_2}{S_1} = 17$$

Therefore, with $\phi_t$=26 mV and $i_{f2}$=1 (for moderate inversion):

$V_{x1}$=238 mV (or $\chi_1$=9.154)

$V_{x2}$=183 mV (or $\chi_2$=7.038)

$V_{x3}$=161 mV (or $\chi_3$=6.192)

$V_{x4}$=134 mV (or $\chi_4$=5.154)

Then, from Equation (1), $V_y$ is equal to:

$$V_y = 716 \text{ mV}.$$

Because, in SCM1 201, transistor M2 is in the saturation region and transistor M1 is in the triode region:

$$I_{D2} \cong I_{F2} = I_{S2} i_{f2} = I_{SQ} S_2 i_{f2} = M I_{ref}$$

$$I_{D1} = I_{F1} - I_{R1} = I_{S1}(i_{f1} - i_{r1}) = I_{SQ} S_1 (i_{f1} - i_{r1}) = (M+N+P+Q+R/\beta) I_{ref}$$

Because $V_{P1}=V_{P2}=V_p$ and $V_{D1}=V_{S2}$, then $i_{r1}=i_{f2}$. Thus:

$$i_{f2} = \frac{M I_{ref}}{I_{SQ} S_2}$$

$$i_{f1} - i_{f2} = \frac{(M+N+P+Q+R/\beta) I_{ref}}{I_{SQ} S_1}$$

Then:

$$i_{f1} = i_{f2} + \frac{(M+N+P+Q+R/\beta) I_{ref}}{I_{SQ} S_1}$$

So, for SCM1 201:

$$\alpha_1 = \frac{i_{f1}}{i_{f2}}$$

-continued $$= 1 + \frac{(M+N+P+Q+R/\beta) I_{ref} S_2}{M I_{ref} S_1}$$

$$= 1 + \frac{S_2}{S_1}\left(1 + \frac{N+P+Q+R/\beta}{M}\right)$$

A general method of designing the bandgap voltage reference 200 comprises the following steps. Decide whether to use a BJT or a diode for the CTAT device 260. After selecting a BJT or a diode, and determining a current budget for the CTAT device 260, simulate the CTAT device 260 and apply a current to the bandgap voltage reference 200 that is near the budgeted current. Estimate the current density of the CTAT device 260. Assuming that a BJT was selected as the CTAT device 260, determine the variation of $V_{EB}$ per degree change of temperature. Estimate a value of the constant $\chi$ needed by the PTAT voltage generator 205 to compensate for the CTAT voltage of the CTAT device 260. The constant $\chi$ is a function of the aspect ratios of transistors M1 and M2 of the SCMs (assuming that each SCM is identical), the mirror ratios of the current mirrors, and $\beta$ of the BJT.

Decide on the number of SCMs that are to be used in the PTAT voltage generator 205. A smaller number of SCMs means that the $V_x$ of each SCM should be larger. A larger $V_x$ for each SCM means that the mirror ratio of the current source coupled to each SCM should be increased and/or the $\alpha$ parameter should be increased. From the number of SCMs, estimate $V_{x1}$ to $V_{xn}$ of the PTAT voltage generator 205 such that the sum of $V_{EB}$ of the CTAT device 260 and $V_y$ of the PTAT voltage generator is approximately the bandgap voltage.

Next, plot the logarithm of the current through transistor M1 versus the gate-to-source voltage ($V_{GS}$) of transistor M1 to determine the operating conditions under which transistor M1 would be in moderate to strong inversion. A transistor operates in weak inversion if the current varies linearly with $V_{GS}$ in the logarithm scale. Once the current attains a knee on the plot and does not vary linearly with $V_{GS}$ in the logarithm scale, a transistor operates in moderate inversion. For example, such a plot may show that a maximum aspect ratio (S=W/L) to be in moderate inversion is 0.1 for 20 nA. However, a maximum aspect ratio of 0.01 to 0.05 should be selected to have a sufficient design margin. Repeat this step for transistor M2. Now, S1 and S2 can be estimated.

Assuming that it has been decided that the number of SCMs is four (4); then, make educated guesses for initial values of the mirror ratios of the current mirrors, and for the inversion factors and the aspect ratios of transistors M1 and M2; then, iteratively make changes thereto during simulation. More specifically, estimate a value for the parameter $\alpha$, as follows. First, scale the size of transistor M1 versus transistor M2 of each SCM 201-204, i.e., decide on an aspect ratio S1 of transistor M1 and an aspect ratio S2 of transistor M2 that will place transistors M1 and M2 in moderate inversion, given a particular mirror current entering the SCM. By "size" it is meant maximum values of aspect ratios S1 and S2, below which values transistors M1 and M2 will be in moderate to strong inversion. Note that the ACM equations shown herein are valid for MOSFETs from weak to strong inversion. The values for channel width and channel length depend upon the process. It is easier to estimate the parameter $\alpha$ than the inversion factor because $\alpha$ depends on only the current mirror ratios and the sizes of transistors M1 and M2. Whereas, the inversion factor depends on the drain current $I_D$, the aspect ratio S and the sheet specific current $I_{SQ}$.

Nevertheless, by using estimates of the above variables and by using the equations $$i_{f1} = \frac{I_{D1}}{I_{SQ}S_1}$$

$$i_{f2} = \frac{I_{D2}}{I_{SQ}S_2}$$

estimates are obtained for the inversion factor $i_{f1}$ for transistor M1 and $i_{f2}$ for transistor M2.

The mirror ratios M, N, P, Q and R are estimated based on the budgeted current. It is assumed that the budgeted current is less than 100 nA. From the estimated mirror ratios M, N, P, Q and R, and from S1, S2 and β, the parameter α for each SCM 201-204 can be determined. From α and the current through each SCM 201-204, the inversion factor can be determined. From a for each SCM 201-204 and the inversion factor, $V_{x1}$, $V_{x2}$, $V_{x3}$ and $V_{x4}$ for each SCM can be determined.

Next, an estimate for $V_{x1}$ of SCM1 201 is determined as follows. Assume that a current of 5 nA is entering the drain of transistor M2 of SCM1 201. (A current of 5 nA assumes that the mirror ratio "a:1" of the current mirror coupled to SCM1 is 1:1, that is, a=M=1.) Further, assume that 20 nA enters the drain of transistor M2 of SCM1 201. (This 20 nA value is a sum of the current entering the CTAT device 260 divided by β of the BJT, and the currents entering SCM2 202, SCM3 203 and SCM4 204. Also, this 20 nA value assumes that there is no trim current.) The parameter $\alpha_1$ for SCM1 can now be determined. In a similar manner, the parameters $\alpha_2$, $\alpha_3$, and $\alpha_4$ for SCM2 202, SCM3 203 and SCM4 204, respectively, are determined. From $\alpha_1$, $\alpha_2$, $\alpha_3$ and $\alpha_4$, initial values $V_{x1}$, $V_{x2}$, $V_{x3}$ and $V_{x4}$ are determined through simulation.

If it is found that $V_{x4}$ is less than $V_{EB}$, the values for $\alpha_1$, $\alpha_2$, $\alpha_3$ and $\alpha_4$ are iteratively increased. The values for $\alpha_1$, $\alpha_2$, $\alpha_3$ and $\alpha_4$ can be increased by decreasing S1 alone, or by increasing S2 alone, but not by too much because then transistor M2 would be entering the weak inversion mode. The values for $\alpha_1$, $\alpha_2$, $\alpha_3$ and $\alpha_4$ can also be increased by both decreasing S1 and increasing S2. Alternatively, the values for $\alpha_1$, $\alpha_2$, $\alpha_3$ and $\alpha_4$ can be increased by increasing the current entering the drain of each SCM 201-204, but this is a less desirable adjustment because it increases power consumption. The current entering an SCM 201-204 affects the inversion factor. Therefore, $V_{x1}$, $V_{x2}$, $V_{x3}$ and $V_{x4}$ should be re-measured after each design iteration. Such iterations continue until a favorable trade-off between area and power consumption is found for the PTAT voltage generator 205. At the end of the design process, the operation regions of all transistors are checked to be sure each transistor is working as desired (moderate/strong inversion and saturation/triode region).

The embodiment of the bandgap voltage reference 200 shown in FIG. 2 requires just one CTAT device 260 and a cascade of several SCMs 201-204 operating between moderate to strong inversion to achieve temperature compensation. Matching requirements are relaxed because the SCMs 201-204 scale the PTAT voltage $V_y$ by properly adjusting a transistor M2/M1 aspect ratio without a strong dependence on current mirrors, resistor array matching or bipolar array matching.

Figure 3:
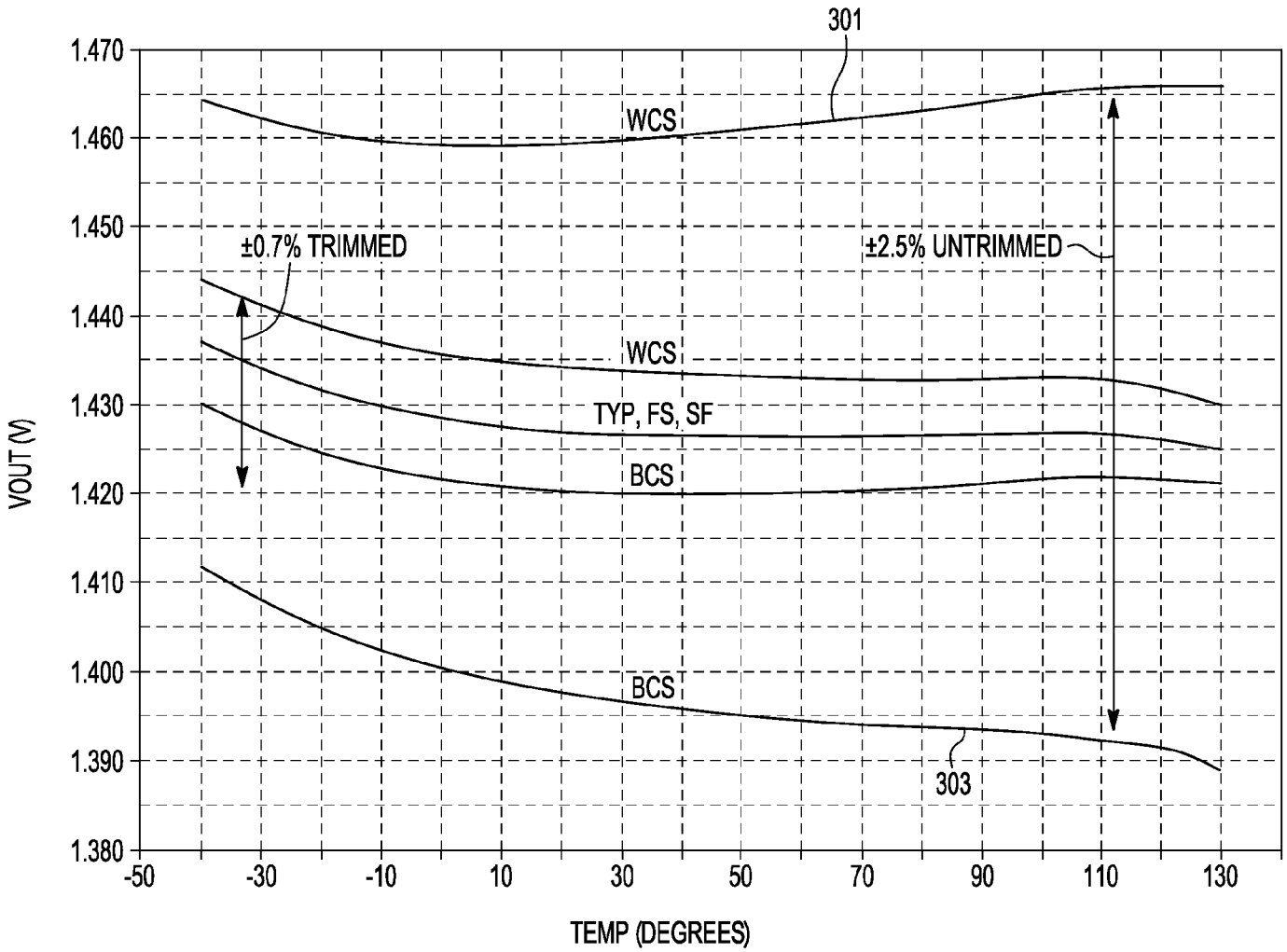
FIG. 3 is a graph of output voltage of the voltage reference circuit of FIG. 2 versus temperature.

FIG. 3 is a chart 300 of output voltage $V_{out}$ of the voltage reference circuit 200 versus temperature for the bandgap voltage reference 200 that was fabricated using a 0.18 micron process and that has a $V_{DD}$ of 3.3V over process fabrication corners. A curve 301 indicates a worst case simulation (WCS), where the threshold voltage of the NMOS and PMOS devices of the voltage reference circuit 200 is higher than nominal. A curve 303 indicates a best case simulation (BCS), where the threshold voltage of the NMOS and PMOS devices of the voltage reference circuit 200 is lower than nominal. When the voltage reference circuit 200 is not trimmed, $V_{out}$ for the WCS corner is 2.5% above a typical (TYP) corner, and $V_{out}$ for the BCS corner is −2.5% below the TYP corner. When the voltage reference circuit 200 is trimmed, such as by using the trim controller 270, it is possible to reduce the variation with regard to the typical corner to 0.7% for the WCS corner and to −0.7% for the BCS corner. In other words, trimming is able to re-center $V_{out}$ to ±0.7% around a target output voltage even if process fabrication deviates to worst and best cases. In FIG. 3, the process corner abbreviation "FS" stands for fast NMOS, slow PMOS; the process corner abbreviation "SF" stands for slow NMOS, fast PMOS. FIG. 3 shows that $V_{out}$ of the bandgap voltage reference 200 for FS and SF corners are very close to $V_{out}$ for a typical corner process. The chart 300 shows that for one embodiment, the reference voltage $V_{out}$ is approximately 1.427V, which is approximately at the bandgap voltage.

Figure 4:
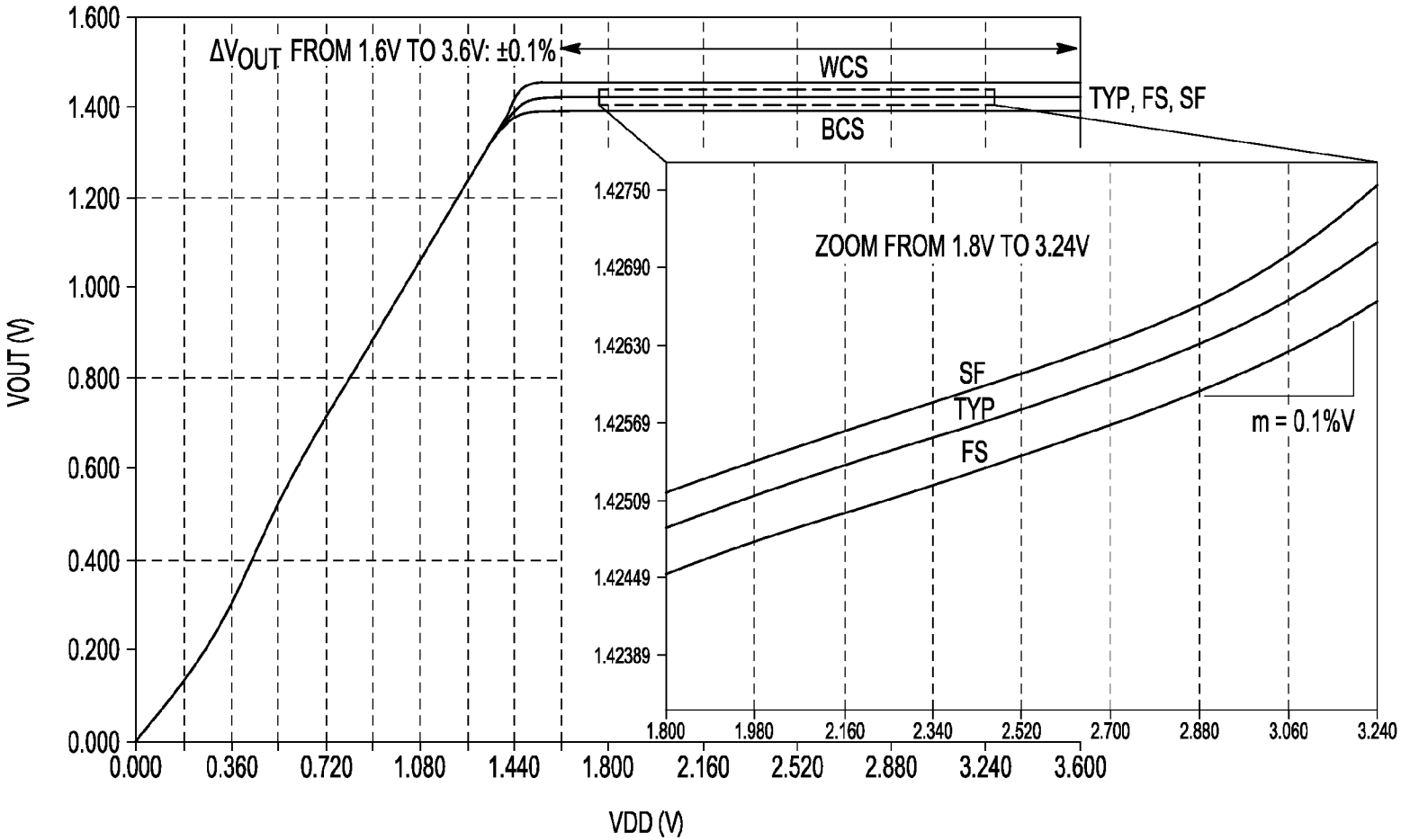
FIG. 4 is a graph of output voltage of the voltage reference circuit of FIG. 2 versus supply voltage.

FIG. 4 is a chart 400 of output voltage $V_{out}$ of the voltage reference circuit 200 versus supply voltage $V_{DD}$. The architecture of the bandgap voltage reference 200 forces $V_{out}$ to advantageously track $V_{DD}$ until $V_{out}$ is established. FIG. 4 shows that the minimum $V_{DD}$ to start to operate is $V_{out}$ plus the minimum drain-to-source voltage to maintain the PMOS current mirrors 249-257 in saturation region ($V_{DSsat}$); as a rule of thumb, it is approximately 100 mV. The architecture of the bandgap voltage reference 200 maintains the output voltage $V_{out}$ well defined. Advantageously, there are not any bounces in $V_{out}$. The zoom portion of the chart 300 shows that for one embodiment, the reference voltage $V_{out}$ is approximately 1.4269V, which is approximately at the bandgap voltage. As shown in the zoom portion of FIG. 4, the bandgap voltage reference unit has a variation with power supply ($\delta V_{out}/\delta V_{DD}$) of approximately 0.1%/V, which is equivalent to a power supply rejection ratio (PSRR) of 60 dB/V.

The bandgap voltage reference 200 does not require an operational amplifier, any feedback, any array of resistors, or any array of bipolar devices. Advantageously, the bandgap voltage reference 200 may use just one bipolar device, such CTAT device 260.

The bandgap voltage reference 200 provides an accurate nanowatt-range voltage reference with the following features: bandgap-approach based; high accuracy (approximately ±2.5% untrimmed and approximately ±0.7% trimmed); accurately compensated over a wide temperature range (−40° C. to 130° C.); supply voltage ($V_{DD}$) tracking below minimum operation voltage (approximately 1.5V); area-effective (resistor-less approach); standard CMOS process compatible; and robust architecture (to support fab-to-fab transference and low spread over process).

A bandgap voltage reference unit comprises the PTAT current source 100 and the bandgap voltage reference 200. The bandgap voltage reference unit has low power consumption (65 nA typical), which is the power consumption of the PTAT current source 100 plus the power consumption of the bandgap voltage reference 200. The bandgap voltage reference unit implements an area-effective, low-power, voltage reference for analog circuits such as regulators, analog-to-digital converters, comparators and oscillators for microcontrollers (MCUs) applications.

Although the invention has been described with respect to specific conductivity types or polarity of potentials, skilled artisans appreciated that conductivity types and polarities of potentials may be reversed.

It should be understood that all circuitry described herein may be implemented in hardware, in software or in firmware, or in any combination of the three. It should be understood that all circuitry described herein may be implemented entirely in silicon or another semiconductor material. Alternatively, all circuitry described herein may be implemented, in part, in silicon or another semiconductor material, and, in part, by software code representation of silicon or another semiconductor material.

The specification and figures are to be regarded in an illustrative rather than a restrictive sense, and all such modifications are intended to be included within the scope of the present invention. Any benefits, advantages or solutions to problems described herein with regard to specific embodiments are not intended to be construed as a critical, required or essential feature or element of any or all the claims. Unless stated otherwise, terms such as "first" and "second" are used to arbitrarily distinguish between the elements such terms describe. Thus, these terms are not necessarily intended to indicate temporal or other prioritization of such elements. Note that the term "couple" has been used to denote that one or more additional elements may be interposed between two elements that are coupled.

Although the invention is described herein with reference to specific embodiments, various modifications and changes can be made without departing from the scope of the present invention as set forth in the claims below.

What is claimed is:

1. A voltage reference circuit, comprising:

a proportional-to-absolute-temperature (PTAT) voltage generator that generates a PTAT voltage, the PTAT voltage generator including a cascade of a plurality of self-cascode MOSFET structures (SCMs), wherein each SCM includes a first transistor coupled to a second transistor in a diode configuration;

a complementary-to-absolute-temperature (CTAT) device, coupled to the PTAT voltage generator, the CTAT device having a CTAT voltage associated therewith;

means for adding the PTAT voltage and the CTAT voltage; and an output, coupled to the means for adding, for providing a voltage reference that does not change with temperature.

2. The voltage reference circuit of claim 1, wherein the first transistor operates in a linear region and the second transistor operates in a saturated region, and wherein the first transistor and the second transistor are biased in moderate inversion.

3. The voltage reference circuit of claim 1, including a PTAT current source wherein each SCM is coupled to the current source.

4. The voltage reference circuit of claim 3, wherein the PTAT current source includes a first transistor and a plurality of output transistors, wherein each output transistor has a mirror ratio with the first transistor of the PTAT current source, and wherein each output transistor operates in strong inversion and in a saturation region.

5. The voltage reference circuit of claim 4, wherein a drain terminal of the second transistor of each SCM is coupled to a drain terminal of one of the output transistors of the current source.

6. The voltage reference circuit of claim 4, wherein the PTAT current source includes a PMOS first transistor and a plurality of PMOS output transistors, each having a mirror ratio with the PMOS first transistor, that mirror a current through the PMOS first transistor, wherein each PMOS output transistor provides a PTAT current to each SCM, respectively.

7. The voltage reference circuit of claim 6, wherein each of SCM includes a NMOS first transistor coupled to a NMOS second transistor in a diode configuration.

8. The voltage reference circuit of claim 7, wherein the NMOS first transistor operates in a linear region and the NMOS second transistor operates in a saturated region, and wherein the NMOS first transistor and the NMOS second transistor are biased in moderate inversion.

9. The voltage reference circuit of claim 7, wherein a drain terminal of a NMOS first transistor of a first SCM of the plurality of SCMs is coupled to the CTAT device, and a drain terminal of a NMOS second transistor of the first SCM of the plurality of SCMs is coupled to a drain terminal of a respective one of the PMOS output transistors of the PTAT current source.

10. The voltage reference circuit of claim 9 wherein a drain terminal of a NMOS first transistor of a second SCM of the plurality of SCMs is coupled to a source terminal of the NMOS first transistor of the first SCM of the plurality of SCMs, and a drain terminal of a NMOS second transistor of the second SCM of the plurality of SCMs is coupled to a drain terminal of a respective one of the PMOS output transistors of the PTAT current source.

11. The voltage reference circuit of claim 1, wherein the CTAT device is a PNP bipolar junction transistor having a base terminal coupled to the PTAT voltage generator, an emitter terminal coupled to the output of the voltage reference circuit and a collector terminal coupled to ground potential, wherein the CTAT voltage is an emitter-to-base voltage of the PNP bipolar junction transistor.

12. The voltage reference circuit of claim 1, wherein the CTAT device is a diode having one terminal coupled to the output of the voltage reference circuit and another terminal coupled to the PTAT voltage generator.

13. The voltage reference circuit of claim 4, including a trim controller coupled to output transistors of the PTAT current source, wherein the trim controller selectively couples one or more of said output transistors to the PTAT voltage generator, to control amount of the PTAT voltage generated by the PTAT voltage generator.

14. A voltage regulator, comprising:

a voltage reference unit, the voltage reference unit including:

a proportional-to-absolute-temperature (PTAT) current source; and a voltage reference circuit, coupled to the PTAT current source, the voltage reference circuit including:

a PTAT voltage generator that generates a PTAT voltage, the PTAT voltage generator including a cascade of a plurality of self-cascode MOSFET structures (SCM), wherein each SCM includes a NMOS first transistor and a NMOS second transistor coupled in a diode configuration;

a complementary-to-absolute-temperature (CTAT) device, coupled to the PTAT voltage generator, the CTAT device having a CTAT voltage associated therewith;

means for adding the PTAT voltage and the CTAT voltage; and an output, coupled to the means for adding, for providing a voltage reference, wherein the voltage reference does not change with temperature.

15. The voltage regulator of claim 14, wherein a drain terminal of the NMOS first transistor of a first SCM is coupled to the CTAT device, and a drain terminal of the NMOS second transistor of the first SCM is coupled to the PTAT current source.

16. The voltage regulator of claim 15 wherein a drain terminal of a NMOS first transistor of a second SCM is coupled to a source terminal of the NMOS first transistor of the first SCM, and a drain terminal of the NMOS second transistor of the first SCM is coupled to the PTAT current source, and a drain terminal of the NMOS second transistor of the second SCM is coupled to the PTAT current source.

17. The voltage regulator of claim 15, wherein the CTAT device is a PNP bipolar junction transistor having a base terminal coupled to the drain terminal of the NMOS first transistor of the first SCM, an emitter terminal coupled to the output of the voltage reference circuit and a collector terminal coupled to ground potential, and wherein the CTAT voltage is an emitter-to-base voltage of the PNP bipolar junction transistor.

18. The voltage regulator of claim 16, including a substrate having a bandgap voltage, wherein the PTAT voltage is selected such that the voltage reference is at the bandgap voltage.

19. An integrated circuit, comprising:

a substrate having a bandgap voltage; and a bandgap voltage reference circuit, the bandgap voltage reference circuit including:

a proportional-to-absolute-temperature (PTAT) voltage generator that generates a PTAT voltage, the PTAT voltage generator including a cascade of a plurality of self-cascode MOSFET structures, wherein each SCM includes a first transistor coupled to a second transistor in a diode configuration;

a complementary-to-absolute-temperature (CTAT) device, coupled to the PTAT voltage generator, the CTAT device having a CTAT voltage associated therewith;

means for adding the PTAT voltage and the CTAT voltage; and an output, coupled to the means for adding, for providing a voltage reference at a bandgap voltage, wherein the voltage reference does not change with temperature.

20. The integrated circuit of claim 19, including a PTAT current source for providing a PTAT current to the bandgap voltage reference circuit.

* * * * *